US006418978B2

(12) United States Patent
Bailly

(10) Patent No.: US 6,418,978 B2
(45) Date of Patent: Jul. 16, 2002

(54) PACKAGING AND DISPENSING DEVICE INCLUDING A VACUUM-FILLED CONTAINER, AND A METHOD OF MANUFACTURE

(75) Inventor: Christian Bailly, Rungis (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/827,212

(22) Filed: Apr. 6, 2001

Related U.S. Application Data

(62) Division of application No. 09/220,791, filed on Dec. 28, 1998.

(30) Foreign Application Priority Data

Jan. 8, 1998 (FR) ..... 98 00134

(51) Int. Cl.[7] ..... B65B 1/04

(52) U.S. Cl. ..... 141/2; 141/4; 141/18; 141/65

(58) Field of Search ..... 141/2, 4, 7, 8, 141/18, 65, 39; 222/321.9, 321.7, 321.3, 321.1, 385, 256

(56) References Cited

U.S. PATENT DOCUMENTS

| | | | | |
|---|---|---|---|---|
| 2,810,496 | A | | 10/1957 | Gray |
| 2,865,540 | A | | 12/1958 | Gray |
| 3,187,673 | A | | 6/1965 | Kramer et al. |
| 3,288,334 | A | | 11/1966 | Corsette |
| 3,834,537 | A | | 9/1974 | Brett |
| 4,121,735 | A | | 10/1978 | Wittersheim |
| 4,515,298 | A | | 5/1985 | Czech |
| 4,713,925 | A | * | 12/1987 | Kafkis |
| 4,826,048 | A | | 5/1989 | Skorka et al. |
| 4,838,460 | A | | 6/1989 | Moore et al. |
| 4,872,596 | A | | 10/1989 | Corsette |
| 4,903,868 | A | | 2/1990 | Ichihara et al. |
| 5,292,033 | A | | 3/1994 | Gueret |
| 5,339,989 | A | | 8/1994 | Coleman |
| 5,505,338 | A | | 4/1996 | Gueret |
| 5,509,584 | A | | 4/1996 | Gueret |
| 5,542,580 | A | | 8/1996 | Hatakeyama et al. |
| 5,590,880 | A | | 1/1997 | Garcia |
| 5,826,756 | A | | 10/1998 | Foster |
| 5,873,491 | A | | 2/1999 | Garcia et al. |
| 5,901,883 | A | | 5/1999 | Ritsche |
| 5,924,604 | A | | 7/1999 | Shimada et al. |
| 6,082,418 | A | * | 7/2000 | Naecker et al. |
| 6,220,310 | B1 | * | 4/2001 | Emmer |

FOREIGN PATENT DOCUMENTS

| | | |
|---|---|---|
| EP | 0 426 408 A2 | 5/1991 |
| EP | 0 591 012 A1 | 4/1994 |
| EP | 0 753 353 A2 | 1/1997 |
| FR | 2 633 249 A1 | 12/1989 |
| FR | 2669244 | 5/1992 |

* cited by examiner

*Primary Examiner*—Steven O. Douglas
(74) *Attorney, Agent, or Firm*—Oliff & Berridge PLC

(57) ABSTRACT

A device for packaging and dispensing at least one fluid substance. The device has at least one container filled with a substance by a vacuum-filling process, a pump associated with the container and having a pump chamber into which the substance is drawn prior to being delivered to the outside, and an anti-vacuum valve-forming device organized to isolate the pump chamber(s) of the pump(s) from the inside(s) of the associated container(s) when a vacuum is established therein for filling purposes.

51 Claims, 5 Drawing Sheets

PACKAGING AND DISPENSING DEVICE INCLUDING A VACUUM-FILLED CONTAINER, AND A METHOD OF MANUFACTURE

This is a Division of application Ser. No. 09/220,791 filed Dec. 28, 1998.

The present invention relates to a device for packaging and dispensing at least one fluid substance.

BACKGROUND OF THE INVENTION

Devices are known for packaging and dispensing a fluid substance that comprise a container for containing the substance and an associated pump, the pump having a pump chamber into which the substance is taken before being delivered to the outside.

The pump has intake valve-forming means and delivery valve-forming means, respectively upstream and downstream from the pump chamber. The pressure required for expelling the substance from the device is obtained by means of a control rod that is movable in the pump chamber. A dispenser endpiece, such as a pushbutton fitted with a nozzle, is fixed to the control rod before the container is filled.

When a user presses on the dispenser endpiece, the control rod is pressed down into the pump body and reduces the volume of the pump chamber, causing a predetermined quantity of substance to be dispensed.

When the user releases the dispenser endpiece, the control rod is returned to its initial position by a spring. This return movement of the control rod is accompanied by an increase in the volume of the pump chamber. The delivery valve-forming means are organized to prevent the substance contained in the dispenser endpiece from returning back into the pump chamber, and also to prevent air penetrating therein. The intake valve-forming means opens while the control rod is returning so as to enable the substance contained in the container to be drawn into the pump chamber.

The container can be constituted by a deformable flexible bag which shrinks as the substance is dispensed, or in a variant it may be formed by a cylindrical wall fitted with a moving bottom, e.g. constituted by a piston capable of sliding therein, or in a variant constituted by a membrane which deforms to occupy the space left empty inside the container by the substance which has been dispensed.

In known packaging and dispensing devices as outlined above, the container can be filled by a vacuum-filling process consisting of establishing suction in the container and then putting the container into communication with a source of the substance so that the substance is drawn into the container.

Such a filling process has the particular advantages of increasing the number of containers filled during production and of avoiding the substance oxidizing on coming into contact with air.

The dispenser endpiece is mounted on the control rod by forcing the control rod into an appropriate housing in the dispenser endpiece, such that the control rod is pushed into the pump body until it comes into abutment at the end of a push-in stroke.

Tests have shown that when the dispenser endpiece is mounted on the control rod after the container has been vacuum-filled, then pushing in the control rod causes a certain quantity of substance to be expelled. This gives rise to dirtying of the substance and increases the risk that any substance contained in the outlet channel of the dispenser endpiece will become degraded on contact with air. This also possibly risks even the outlet channel becoming blocked once the substance has dried.

There also exists a need for packaging and dispensing devices that have two independent containers and two pumps for simultaneously dispensing two substances that are stored separately in each of the containers.

Mounting a common dispenser endpiece on the control rods of the two pumps after the containers have been vacuum-filled would give rise to the above-mentioned drawbacks, while mounting the dispenser endpiece before the containers are filled makes the device more complicated to manufacture.

OBJECTS AND SUMMARY OF THE INVENTION

The present invention seeks in particular to enable the dispenser endpiece to be mounted on the control rod(s) of the pump(s) after vacuum-filling the container(s), but without the drawbacks mentioned above.

According to the invention, this is achieved by the fact that the packaging and dispensing device includes anti-vacuum valve-forming means organized to isolate the pump chamber(s) of the pump(s) from the inside(s) of the associated container(s) when a vacuum is established therein for filling purposes.

Thus, by means of the invention, a vacuum is not established in the pump chamber when the air initially present in the associated container is drawn out, such that when the container is put into communication with the source of substance, only the container is filled and not the pump chamber.

As a result, when the dispenser endpiece is subsequently fixed on the control rod(s) and the control rod(s) is/are pushed into the pump body(ies), no substance flows out through the dispenser endpiece.

By means of the invention, the dispenser endpiece therefore remains substantially free of substance during storage, and any risk of dirtying, degradation, or drying of the substance is avoided.

In other words, the invention makes it possible to avoid untimely dispensing of a small quantity of substance when the dispenser endpiece is put into place on the control rod(s).

The invention makes it possible in particular to mount two pumps each fitted with a respective container constituted by a flexible bag inside a case, and then fitting a cover on the case to serve both as an actuator for the pump control rods and to dispense the mixture of substances contained in the containers.

The invention is also advantageous when the dispenser endpiece is already fixed on a control rod before the container is filled.

Under such circumstances, any accidental thrust on the dispenser endpiece is then avoided during boxing or transportation, for example, so no substance flows out from the dispenser endpiece.

In known pumps, the intake valve-forming means are constituted by a ball, which therefore provides sealing only when the pump is used in a predetermined position, e.g. head-up.

The anti-vacuum valve-forming means of the invention are preferably capable of providing sealed closure in any position, thereby increasing the number of ways in which the pump can be used.

In a particular embodiment, the anti-vacuum valve-forming means form an integral portion of the pump and also act as the intake valve, enabling the substance contained in the container to be drawn into the pump chamber while preventing it from returning when the control rod is pushed in.

In a variant embodiment, the anti-vacuum valve-forming means are fitted to the pump, which is manufactured separately and may be constituted by a prior art pump that is unmodified or that has been subjected to modifications that are minor and not expensive.

By way of example, the pump can be of the type having a valve that is constituted by a ball and/or a control rod engaged with a return spring.

In another embodiment, the anti-vacuum valve-forming means comprise a support piece secured to the container with the pump being fixed thereto.

In another variant, the anti-vacuum valve-forming means are secured to the container.

The invention also provides a method of manufacturing a device for packaging and dispensing at least one fluid substance, said device having at least one container for containing a substance and a pump for dispensing it, the pump having a pump chamber into which, in operation of the pump, the substance is drawn prior to being delivered to the outside, the method comprising the steps consisting in:

- assembling together the pump, the container, and anti-vacuum valve-forming means, the container being suitable for communicating via a first opening with the pump chamber via the anti-vacuum valve-forming means;
- evacuating the inside of the container via a second opening thereof, the anti-vacuum valve-forming means isolating the container from the pump chamber during the evacuation step;
- filling the container by causing it to communicate via said second opening with a source of substance; and
- closing said second opening.

The invention also provides a method of manufacturing a packaging and dispenser device having two containers for separately containing respective substances, and two pumps respectively associated with said containers for dispensing said substances simultaneously, each of the pumps having a pump chamber into which, during operation of the pump, the substance is drawn prior to being delivered to the outside, the method comprising the steps consisting in:

- assembling each pump fitted with anti-vacuum valve-forming means to the associated container;
- filling each container separately by a vacuum-filling process;
- inserting both pumps and the associated containers in a case; and
- fitting the case with a dispenser endpiece common to both pumps.

BRIEF DESCRIPTION OF THE DRAWINGS

Other characteristics and advantages of the present invention appear on reading the following detailed description of non-limiting embodiments of the invention, and on examining the accompanying drawings, in which.

DETAILED DESCRIPTION OF PREFERRED EMBODIMENTS

Figure 1:
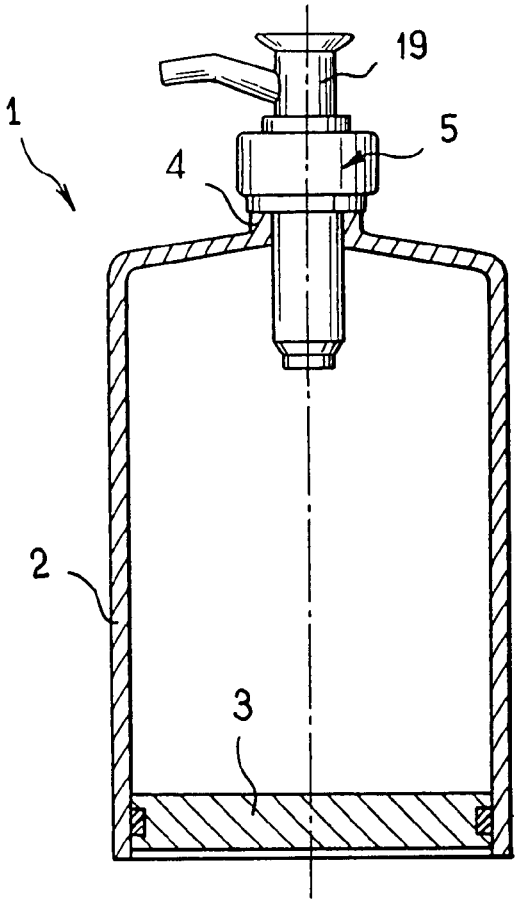
FIG. 1 PRIOR ART
FIGS. 1 and 2 are diagrams showing a prior art packaging and dispensing device.

FIG. 1 shows a prior art packaging and dispensing device 1.

The device 1 comprises a container constituted by a cylindrical-walled container 2 fitted with a moving bottom constituted by a piston 3 that slides in sealed manner inside the wall 2.

Figure 2:
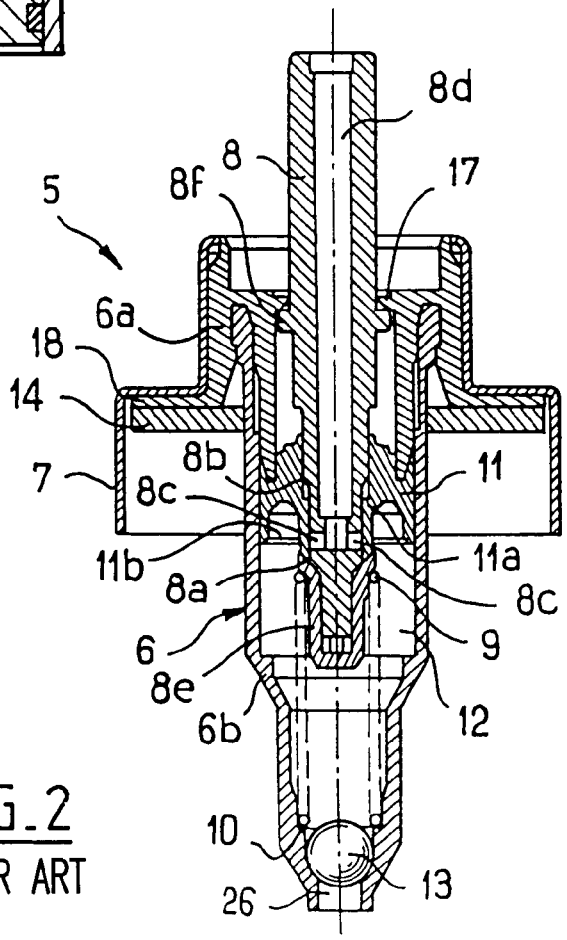
FIG. 2 PRIOR ART

The container 2 has a neck 4 at its top end on which there is fixed a pump 5 which is shown in section in FIG. 2.

The pump 5 comprises a pump body 6 constituted by snap-fastening together a top portion 6*a* and a bottom portion 6*b*.

A control rod 8 is mounted so that its bottom portion slides inside the body 6 against the action of a return spring 9 that operates in compression, one end of the spring 9 bearing against a shoulder 10 at the bottom of the bottom portion 6*b* of the body 6, and its other end bearing against a shoulder 8*a* on an endpiece 8*b* fixed to the bottom end of the control rod 8.

The top portion 6*a* has a flange 18 serving to mount the pump S together with a sealing ring 14 situated beneath the flange for sealed fixing to the container, with mounting being provided by a metal ring 7 that can be crimped to the neck 4 of the container 2.

The control rod 8 has an axial bore 8*d* extending from above the endpiece 8*e* to the top end of the rod.

A dispenser endpiece 19 serving both as an actuator member and as a nozzle is force-fit on the top end of the control rod 8.

A piston 11 is mounted around the control rod 8 inside the bottom portion 6*b* of the body 6.

The piston 11 slides in contact simultaneously with the bottom portion 6*b* and with the control rod 8, and has an inside shoulder 11*a* against which there bears a shoulder 8*a* of the control rod 8 after it has been pushed in a short distance.

The bottom portion of the piston 11 has a skirt 11*b* against which the endpiece 8*e* of the control rod 8 bears at rest, i.e. when it comes into abutment via a shoulder 8*f* situated above the piston 11 engaging a narrowing 17 of the top portion 6*a*.

The control rod 8 has radial holes 8*c* communicating with the axial bore 8*d* at its bottom end and enabling a substance to be conveyed to the dispenser endpiece 19.

The bottom portion 6*b* serves as a seat for a ball 13 which, at rest, closes an orifice 26.

The piston 11 and the ball 13 define a pump chamber 12 inside the body 6.

When the control rod 8 is at rest, the holes 8*c* are closed by the skirt 11*b* of the piston 11.

When the user presses on the dispenser endpiece 19, the control rod 8 is pushed into the body 6.

At the beginning of the push stroke of the control rod 8, the piston 11 is not driven by the control rod 8 so long as the shoulder 8*b* has not come into abutment against the shoulder 11*a* of the piston 11.

The control rod 8 thus moves relative to the piston 11 and the endpiece 8*e* ceases to bear against the skirt 11*b*.

The holes 8*c* then communicate with the pump chamber 12 via the gap which exists between the control rod 8 and the bottom edge of the skirt 11*b*.

As the push stroke of the control rod 8 continues, the shoulder 8*b* comes to bear against the shoulder 11*a* and the piston 11 is moved downwards together with the control rod 8.

The substance is then expelled from the pump chamber 12 by the movement of the piston 11 and it passes into the axial bore 8*d* via the holes 8*c* in order to be dispensed.

While the control rod 8 is moving downwards, the ball 13 remains pressed against its seat in the bottom of the bottom portion 6*b* of the body 6, and prevents any substance being returned to the container.

When the user releases the dispenser endpiece 19, the control rod 8 initially slides within the piston 11 until its endpiece 8*e* comes to bear against the bottom edge of the skirt 11*b*.

The axial bore 8*d* is then isolated from the pump chamber 12, and continued upwards movement of the control rod 8 under drive from the spring 9 generates suction in the pump chamber 12, which is accompanied by the ball 13 lifting and substance coming in from the container.

The inventors have found that with known pumps, if a vacuum is formed in the container prior to the container being filled, then the ball 13 does not close off the pump chamber 12 with sufficient sealing, such that the air present therein is sucked into the container.

In particular, if the container is filled while head-down, the ball 13 leaves its seat under gravity and is completely incapable of isolating the pump chamber 12.

As a result, when the container at low pressure is put into communication with the source of substance for filling purposes, some substance is also drawn into the pump chamber 12 because of the suction present therein.

The invention seeks to remedy that drawback.

Figure 3:
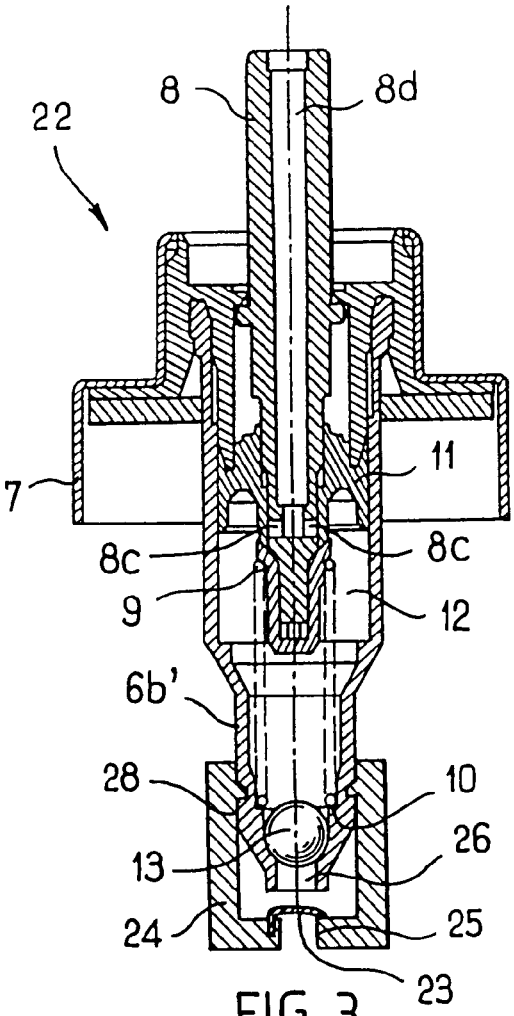
FIG. 3 is a diagrammatic axial section view of a pump constituting a first embodiment of the invention.

FIG. 3 is a diagrammatic axial section showing a first embodiment of a pump of the invention, which pump is given reference 22 and differs from above-described pump 5 in that the bottom portion of the pump body, now referenced 6*b*', has an external annular groove 28, and in that it is provided with an anti-vacuum valve 23 secured to a support piece 24 which in turn is snap-fastened in the groove 28.

The anti-vacuum valve 23 is specially designed to prevent the air initially present in the pump chamber 12 from being drawn out when the container is evacuated for filling purposes.

In the example shown, the anti-vacuum valve 23 is made of elastomer material, being overmolded on the support piece 24 or, in a variant, being made by dual injection therewith.

The support piece 24 is pierced by an orifice 25 which, at rest, is closed by the anti-vacuum valve 23, and which when the control rod 8 rises, allows the substance to reach the orifice 26.

The orifice 25 is closed by the valve 23 with the necessary amount of sealing, even when the container is head-down and has suction established therein.

Although the pump 22 is shown as having a ball 13, the ball 13 could be omitted, in which case the valve 23 would also act as the intake valve.

With reference to FIGS. 4 to 7, there follows a description of the various steps in the process whereby the container is vacuum-filled, and also of the process whereby the dispenser endpiece 19 is put into place on the control rod 8.

Figure 4:
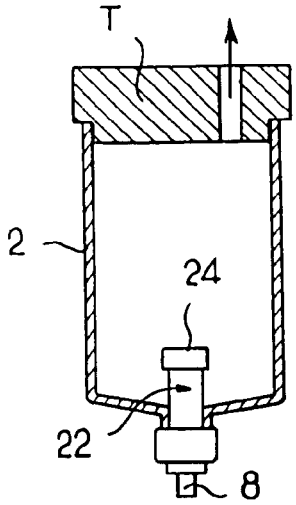
FIGS. 4 to 7 show various steps in the vacuum-filling process followed by installation of the dispenser endpiece on the control rod of the pump.

Initially, as shown in FIG. 4, the container 2 is placed upside-down, and then the head T of a vacuum-filler is applied in sealed manner against the bottom of the container 2.

Air is then sucked out therefrom via a channel through the head T.

While a vacuum is being established inside the container 2, the valve 23 is pressed firmly against its seat on the support piece 24 and prevents the air contained in the pump chamber 12 from escaping.

The vacuum established in the container 2 is relative only, and it suffices in the invention for filling to take place under a pressure that is lower than atmospheric pressure.

Figure 5:
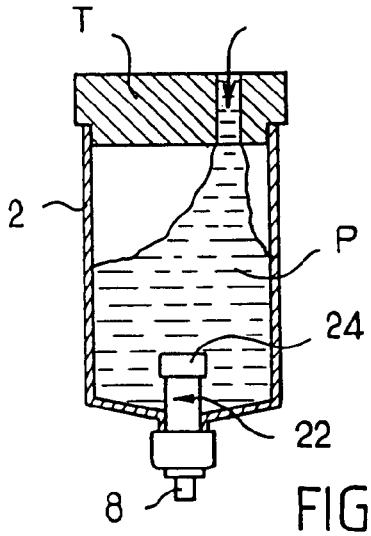

Thereafter, as shown in FIG. 5, the inside of the container 2 is put into communication with a source of substance P, and the substance passes through the head T into the inside of the container, as shown in FIG. 5.

Since the pump chamber 12 is not at reduced pressure, no substance is sucked into it.

Figure 6:
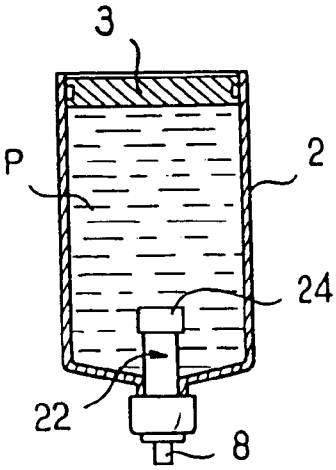

Once the container 2 has been filled, the moving bottom constituted by the piston 3 is put into place, as shown in FIG. 6.

Figure 7:
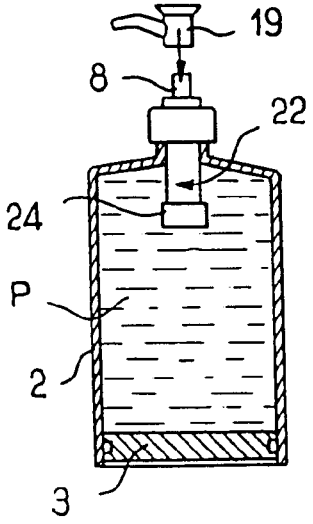

Thereafter, the container 2 is turned the right way up and the endpiece 19 can be fixed on the control rod 8, as shown in FIG. 7.

Although the control rod 8 is pushed in while the endpiece 19 is being put into place therein, no substance is caused to escape because the pump chamber 12 does not contain any.

In the embodiment described above, the anti-vacuum valve 23 is added to the pump, and the pump differs from known pumps only in a minor modification consisting in providing the groove 28.

Figure 8:
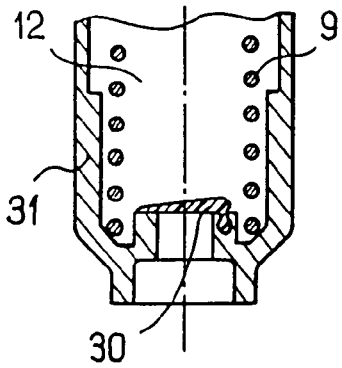
FIG. 8 is a fragmentary and diagrammatic axial section of a variant embodiment.

In the variant embodiment shown in FIG. 8, the anti-vacuum valve, now referenced 30, is an integral part of the pump, being overmolded on the body thereof, referenced 31, or being made by dual injection therewith.

The anti-vacuum valve 30 replaces the ball 13 of the above-described pump 5 and provides the pump with better sealing against the vacuum created in the container prior to being filled. The remainder of the pump is similar.

Once the container has been filled, the valve 30 acts in the same manner as the ball 13 enabling substance to penetrate into the pump chamber 12 while the control rod is rising and preventing substance from being returned to the container while the user is pushing down the dispenser endpiece 19.

Figure 9:
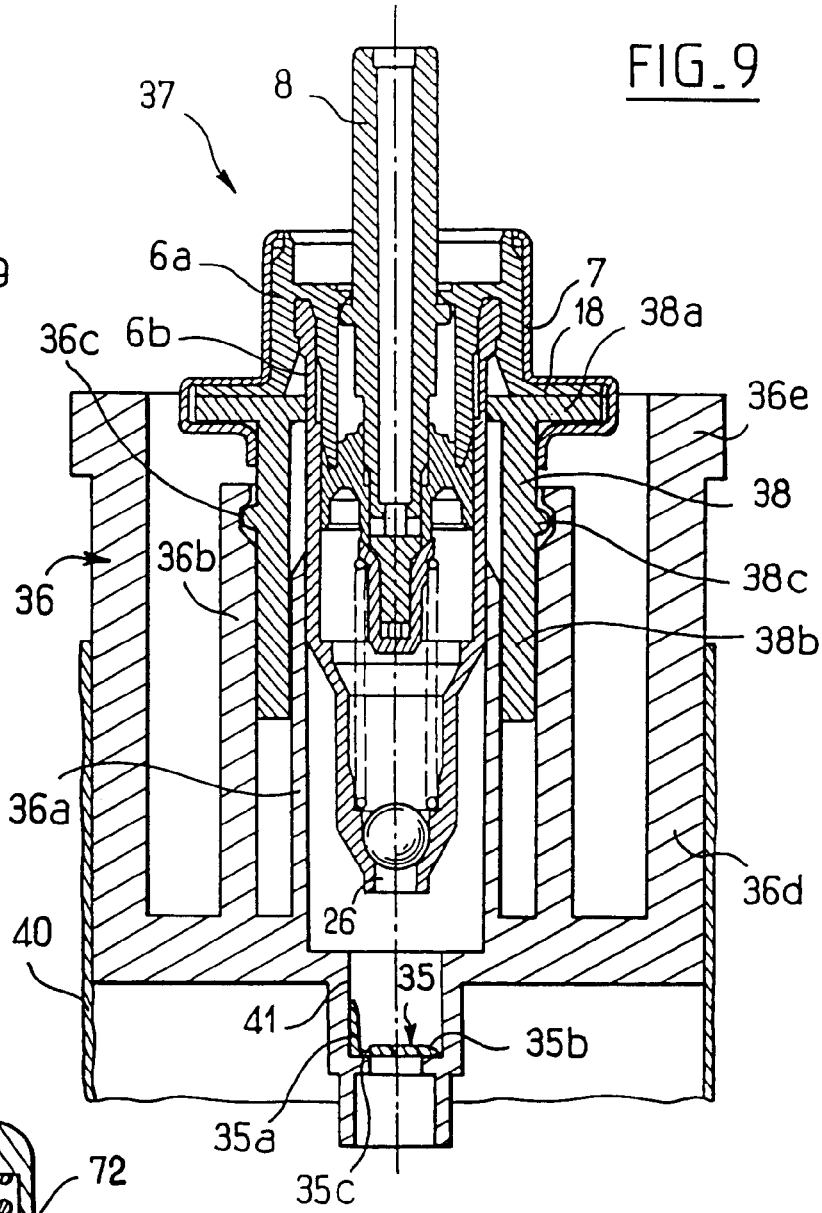
FIG. 9 shows another variant embodiment.

In another variant, shown in FIG. 9, the anti-vacuum valve, now referenced 35, is made on an independent support piece 36.

The pump, now referenced 37, is fixed to the support piece 36.

The pump 37 is identical to the pump 5 shown in FIG. 2 except that it does not have a sealing ring 14, the flange 18 of the top portion 6*a* of the pump body resting directly against an intermediate piece 38, against which the pump is held by crimping the ring 7.

The top portion of the intermediate piece 38 has a flange 38*a* which bears against the flange 18 and which has a bottom skirt 38*b* extending concentrically around the bottom portion 6*b* of the pump body.

The support piece 36 has a sealing skirt 36*a* shaped to bear in sealed manner against the bottom portion 6*b* of the pump body, in the annular space that exists between said bottom portion 6*b* and the skirt 38*b*.

The support piece 36 also has a skirt 36*b* serving for fixing the intermediate piece 38, and provided with an annular groove 36*c* in which a bead 38*c* formed on the radially outer surface of the skirt 38*b* is snap-fastened.

Finally, the support piece 36 has an outer skirt 36*d* provided at its top end with a rim 36*e*, said skirt 36*d* being designed to fix the assembly to a case and also serving for fixing to a deformable flexible bag 40 acting as the container.

The anti-vacuum valve 35 is made by overmolding in a housing 41 of the support piece 36, which housing opens out to the inside of the sealing skirt 36*a* beneath the orifice 26 of the pump.

The anti-vacuum valve 35 has a fixed portion 35*a* fixed to the side wall of the housing 41, and a moving portion 35*b* connected to the fixed portion via a hinge-forming bridge of material 35*c*, the moving portion 35*b* being capable of being lifted to allow substance to pass towards the pump 37. At rest, the moving portion 35*b* closes the orifice provided in the bottom of the housing 41.

Figure 10:
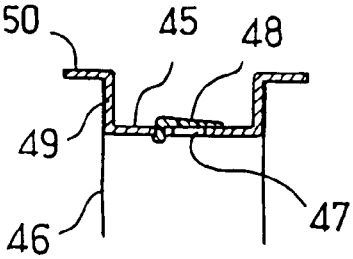
FIG. 10 shows another embodiment of the anti-vacuum valve-forming means.

In a variant, the anti-vacuum valve could equally well be made on a support piece 45 used only for fixing a container-forming bag 46, as shown in FIG. 10.

In axial section, this support piece 45 is generally U-shaped, with a central orifice 47 being provided in the bottom thereof.

The anti-vacuum valve, now referenced 48, is fixed to the support piece 45 in such a manner as to close the orifice 47 when a vacuum is established in the bag 46.

The bag 46 is fixed by any known means to the outside surface of the side wall 49 of the support piece 45, e.g. by ultrasonic bonding.

The side wall 49 extends radially outwards at its top end to form a collar 50 enabling it to be fixed inside a case carrying, above the support piece 45, the pump used for extracting the substance contained in the bag.

Figure 11:
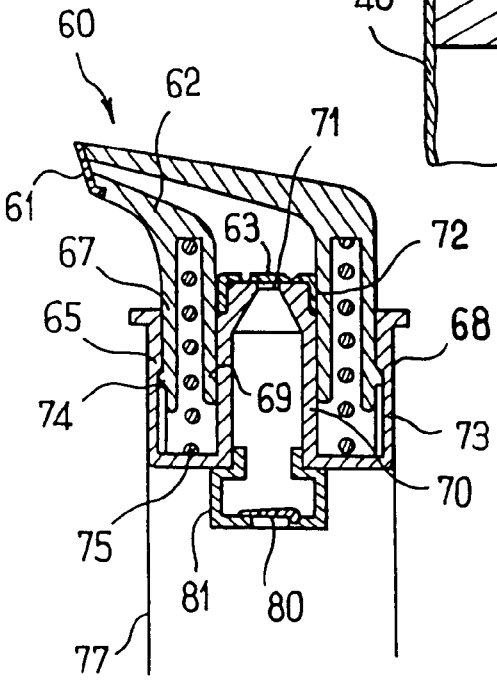
FIG. 11 shows another embodiment of the invention.

The invention also applies to a pump as shown in FIG. 11 and referenced 60.

This pump 60 has a delivery valve 61 formed at the outside end of the outlet channel of the dispenser endpiece 62.

The dispenser endpiece 62 is integrally formed with the control rod, which control rod is double-walled.

The pump body, now referenced 65, has a circularly cylindrical central wall 70 which is extended outwards at its bottom end to form an upwardly-open U-shaped groove serving as a guide in which the double-wall of the dispenser endpiece 62 slides.

The radially-outer wall 67 slides in contact with the radially-outer wall 68 of the body 65 while the radially-inner wall 69 slides in contact with the wall 70.

This wall extends upwards in narrowed form so as to define an orifice 71 at its top end, which orifice is closed by a valve 63 when the dispenser endpiece 62 is pressed down into the body 65.

A sealing ring 72 is made at the periphery of the valve 63 to ensure that the wall 69 slides in sealed manner over the wall 70.

An annular groove 73 is formed on the radially-inner surface of the wall 68 to retain portions in relief 74 projecting radially outwards from the wall 67 and to limit the up stroke of the dispenser endpiece.

A compression spring 75 has one end bearing against the end wall of the groove formed between the walls 67 and 69, and has its other end bearing against the end wall of the groove formed between the walls 68 and 70.

In this case, the pump chamber is constituted by the channel inside the dispenser endpiece 62, the outside end of this channel being defined by the valve 61 and the inside end thereof by the valve 63.

A deformable bag 77 is fixed to the radially-outer surface of the wall 68.

In a variant, the pump 60 is fixed by minor modifications to the body 65 to a container 2 having a moving bottom, as described above.

In known pumps, the intake valve 63 is not designed to provide sealing against a vacuum.

In the invention, an anti-vacuum valve 80 carried by a support piece 81 is secured to the body 65 by any means known to the person skilled in the art.

FIGS. 12 to 18 show how a container-forming flexible bag is filled and closed.

The flexible bag, referenced 90, is initially fixed onto a support or a pump, provided with an anti-vacuum valve of the invention.

The assembly is supported by a retaining device 91 on which there is applied a bell 92 through which there passes a filler nozzle 93.

The bell 92 is provided with means 94 that are shown in part only and that serve to control the low pressure that obtains therein.

The pressure inside the bell 92 is reduced by sucking out the air contained therein, said air leaving the bottom of the device 91 via a duct 95.

Figure 12:
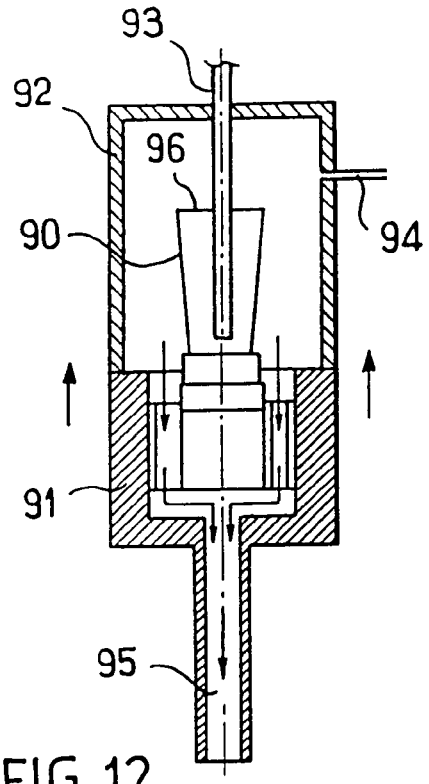
FIGS. 12 to 18 show the process of filling and closing a flexible bag constituting a container.

The bag 90 has an open bottom 96 that is upwardly directed, as shown in FIG. 12.

Figure 13:
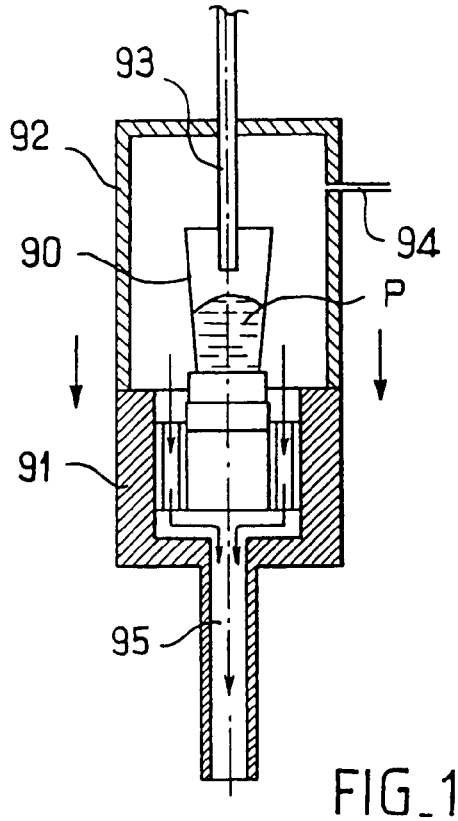

Once suction has been established inside the bell 92, the substance P is delivered via the nozzle 93. The bell 92 and the holding device 91 move down relative to the nozzle while the level of substance P in the bag 90 rises, as shown in FIG. 13, so that the bottom end of the nozzle 93 is maintained above the level of substance in the bag.

The bell 92 is kept under suction throughout the time required for filling.

Figure 14:
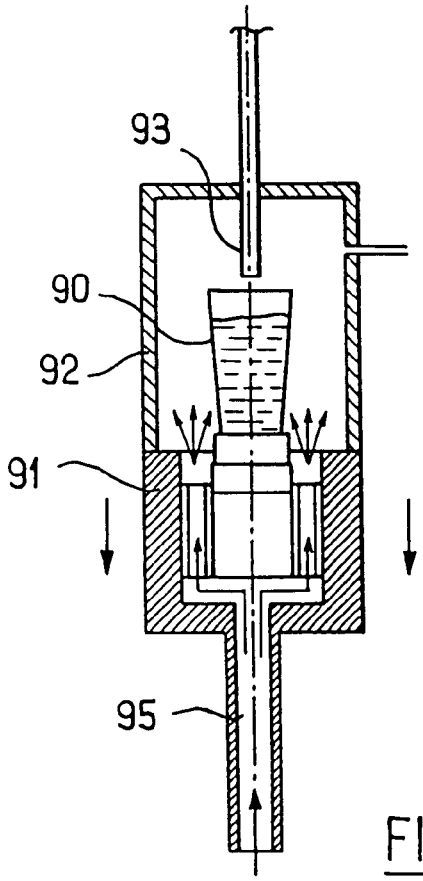

At the end of filling, as shown in FIG. 14, the nozzle 93 is situated outside the bag, and the vacuum is broken by allowing air to enter via the duct 95.

Figure 15:
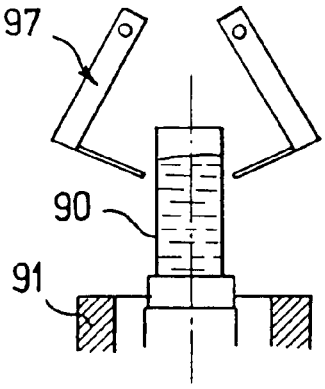

Thereafter, the bell 92 is removed and the full bag 90 is taken to a closure station provided with a device 97 for pinching together and sealing the walls of the bag, as shown in FIG. 15.

Figure 16:
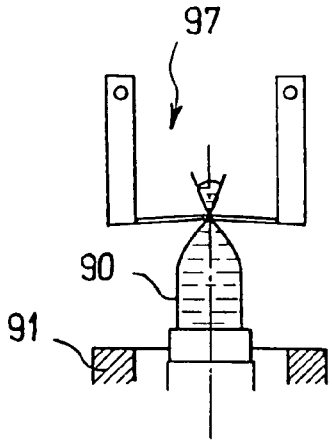
Figure 17:
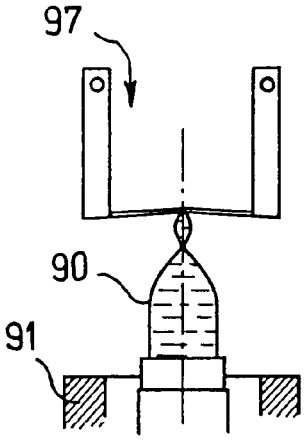
Figure 18:
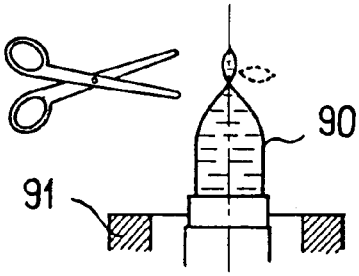

The bottom 96 of the bag is pinched together and sealed in two locations one above the other, as shown in FIGS. 16 and 17, and then the portion of the bag that exists between the two lines of sealing is cut off, as shown in FIG. 18.

Figure 19:
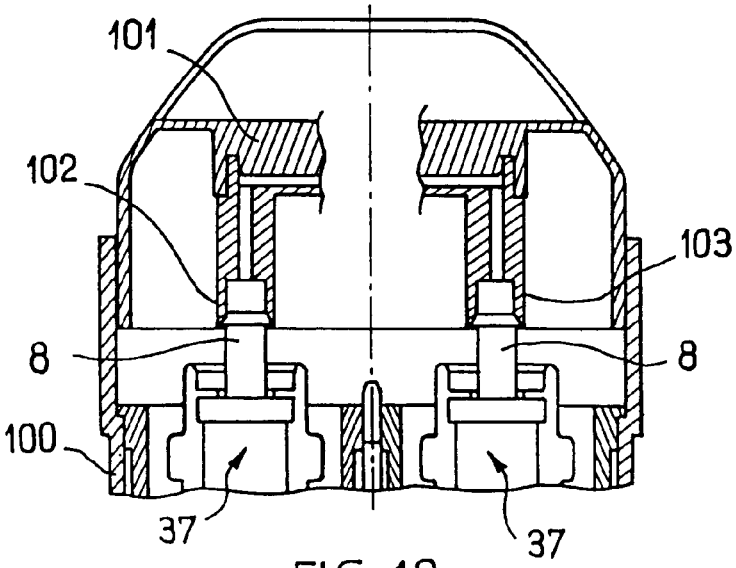
FIG. 19 is a diagrammatic fragmentary section view of a packaging and dispensing device constituting a last embodiment of the invention.

The invention is advantageously implemented to provide a device for packaging and dispensing, as shown in FIG. 19, having two pumps like the pumps 37 described with reference to FIG. 9, each pump having its own anti-vacuum valve and being associated with a respective flexible bag 40 forming a container, both bags being placed inside a common case 100.

Each bag 40 is individually filled by the method described with reference to FIGS. 12 to 18.

Once both pumps 37 have been put into place in the case 100, a common dispenser endpiece 101 is put into place on the control rods 8.

The dispenser endpiece 101 has two housings 102 and 103 which fit over the ends of the control rods 8 and which communicate with a common outlet nozzle that is not shown in order to clarify the drawing.

What is claimed is:

1. A method of filling a container with a substance to be dispensed with a pump, the pump having a pump chamber and at least one valve, the method comprising introducing the substance into the container equipped with the pump, the pump chamber being, during the filling of the container, maintained at a pressure higher than the pressure in the container.

2. A method according to claim 1, wherein the container is filled under vacuum.

3. A method according to claim 1, wherein the pump chamber is maintained, during the filling of the container, at a pressure higher than the pressure in the container by using a one way valve capable, in a closed position, of isolating the pump chamber from the container.

4. A method according to claim 1, wherein the pump is fixed at a first end of the container and the container is filled through a second end of the container, the second end being opposed to the first end.

5. A method according to claim 1, wherein a pushbutton forming endpiece is fitted to a control rod of the pump after filling of the container.

6. A method according to claim 1, wherein a further one way valve is mounted on the pump prior to filling of the container, the further one way valve isolating from the container, in a closed position, the at least one valve of the pump.

7. A method according to claim 1, wherein the method comprises mounting on the pump, prior to filling the container, a further one way valve capable of isolating, in a closed position, the pump from the container.

8. A method according to claim 7, wherein the mounting comprises the snapping on the pump of a support of the further one way valve.

9. A method according to claim 1, wherein the method further comprises the mounting of the pump, prior to filling the container, on a support fixed on the container.

10. A method according to claim 1, wherein the method comprises establishing a vacuum in the container for filling purposes and subjecting the pump to vacuum.

11. A method according to claim 1, wherein the method comprises isolating the pump chamber from the container during the filling of the container using a further one way valve comprising a valve member made of elastomer material.

12. A method according to claim 1, wherein the method comprises mounting the pump on the container, the pump further comprising a one way inlet valve through which the substance is drawn in the pump chamber, the one way inlet valve comprising a valve member constituted by a ball, wherein the method further comprises isolating the one way inlet valve from the container using a further one way valve upstream of the pump.

13. A method of manufacturing a dispenser device having two containers for separately containing respective substances, and two pumps respectively associated with the containers for dispensing the substances simultaneously, each of the pumps having a pump chamber into which, during operation of the pump, the substance is drawn prior to being delivered to the outside, the method comprising:

assembling each pump fitted with at least one valve to the associated container, the valve being capable of isolating in a closed position the pump chamber from the container;

filling each container separately by a vacuum-filling process;

inserting both pumps and the associated containers in a case; and fitting the case with a dispenser endpiece common to both pumps.

14. A method of manufacturing a device for dispensing at least one fluid substance, the device having at least one container for containing a substance and a pump for dispensing the substance, the pump having a pump chamber into which, in operation of the pump, the substance is drawn prior to being delivered to the outside, the method comprising:

assembling together the pump, the container, and at least one valve, the container being suitable for communicating with the pump chamber via the valve;

evacuating the container via an opening thereof, the valve isolating the pump chamber from the container during the evacuation step;

filling the container by causing it to communicate via the opening with a source of substance; and closing the opening.

15. A method of filling a container with a substance to be dispensed with a pump, said pump having a pump chamber, said method comprising introducing said substance into the container equipped with said pump, said pump chamber being, during the filling of said container, maintained at a pressure higher than the pressure in said container by using a one way valve capable, in a closed position, of isolating the pump chamber from the container.

16. A method according to claim 15, wherein the one way valve is manufactured separately from the pump.

17. A method according to claim 15, wherein the one way valve is manufactured with the pump.

18. A method according to claim 17, wherein the one way valve is integral with the pump.

19. A method according to claim 15, wherein said container is filled under vacuum.

20. A method according to claim 15, wherein a pushbutton forming endpiece is fitted to a control rod of the pump after filling of the container.

21. A method according to claim 20, wherein the fitting of said endpiece is accompanied by the control rod being pushed into the pump.

22. A method according to claim 15, wherein the method comprises establishing a vacuum in the container for filling purposes and subjecting the pump to vacuum.

23. A method of filling a container with a substance to be dispensed with a pump, said pump having a pump chamber, said method comprising introducing said substance into the container equipped with said pump, said pump chamber being, during the filling of said container, maintained at a pressure higher than the pressure in said container, wherein a pushbutton forming endpiece is fitted to a control rod of the pump after filling of the container.

24. A method according to claim 23, wherein the fitting of the endpiece is accompanied by the control rod being pushed into the pump.

25. A method according to claim 23, wherein said container is filled under vacuum.

26. A method according to claim 23, wherein the method comprises establishing a vacuum in the container for filling purposes and subjecting the pump to vacuum.

27. A method of filling a container with a substance to be dispensed with a pump, said pump having a pump chamber, said method comprising introducing said substance into the container equipped with said pump, said pump chamber being, during the filling of said container, maintained at a pressure higher than the pressure in said container, wherein a one way valve is mounted on the pump prior to filling of the container, said one way valve isolating from the container, in a closed position, a one way inlet valve of the pump through which substance is drawn in said pump chamber.

28. A method according to claim 27, wherein said container is filled under vacuum.

29. A method according to claim 27, wherein a pushbutton forming endpiece is fitted to a control rod of the pump after filling of the container.

30. A method according to claim 29, wherein the fitting of said endpiece is accompanied by the control rod being pushed into the pump.

31. A method according to claim 27, wherein the method comprises establishing a vacuum in the container for filling purposes and subjecting the pump to vacuum.

32. A method of filling a container with a substance to be dispensed with a pump, said pump having a pump chamber, said method comprising introducing said substance into the container equipped with said pump, said pump chamber being, during the filling of said container, maintained at a pressure higher than the pressure in said container, wherein said method comprises mounting on said pump, prior to filling the container, a one way valve capable of isolating, in a closed position, said pump from said container.

33. A method according to claim 32, wherein said container is filled under vacuum.

34. A method according to claim 32, wherein a pushbutton forming endpiece is fitted to a control rod of the pump after filling of the container.

35. A method according to claim 34, wherein the fitting of said endpiece is accompanied by the control rod being pushed into the pump.

36. A method according to claim 32, wherein the method comprises establishing a vacuum in the container for filling purposes and subjecting the pump to vacuum.

37. A method of filling a container with a substance to be dispensed with a pump, said pump having a pump chamber, said method comprising introducing said substance into the container equipped with said pump, said pump chamber being, during the filling of said container, maintained at a pressure higher than the pressure in said container, wherein said method further comprises mounting said pump, prior to filling said container, on a support fixed on said container.

38. A method according to claim 37, wherein said container is filled under vacuum.

39. A method according to claim 37, wherein a pushbutton forming endpiece is fitted to a control rod of the pump after filling of the container.

40. A method according to claim 39, wherein the fitting of said endpiece is accompanied by the control rod being pushed into the pump.

41. A method according to claim 37, wherein the method comprises establishing a vacuum in the container for filling purposes and subjecting the pump to vacuum.

42. A method of filling a container with a substance to be dispensed with a pump, said pump having a pump chamber, said method comprising introducing said substance into the container equipped with said pump, said pump chamber being, during the filling of said container, maintained at a pressure higher than the pressure in said container, wherein said method comprises isolating said pump chamber from the container during the filling of said container using a one way valve comprising a valve member made of elastomer material.

43. A method according to claim 42, wherein said container is filled under vacuum.

44. A method according to claim 42, wherein a pushbutton forming endpiece is fitted to a control rod of the pump after filling of the container.

45. A method according to claim 44, wherein the fitting of said endpiece is accompanied by the control rod being pushed into the pump.

46. A method according to claim 42, wherein the method comprises establishing a vacuum in the container for filling purposes and subjecting the pump to vacuum.

47. A method of filling a container with a substance to be dispensed with a pump, said pump having a pump chamber, said method comprising introducing said substance into the container equipped with said pump, said pump chamber being, during the filling of said container, maintained at a pressure higher than the pressure in said container, wherein said method comprises mounting on the container the pump, said pump comprising a one way inlet valve through which the substance is drawn in the pump chamber, said one way inlet valve comprising a valve member constituted by a ball, wherein said method further comprises isolating said one way inlet valve from said container using a further one way valve upstream of said pump.

48. A method according to claim 47, wherein said container is filled under vacuum.

49. A method according to claim 47, wherein a pushbutton forming endpiece is fitted to a control rod of the pump after filling of the container.

50. A method according to claim 49, wherein the fitting of said endpiece is accompanied by the control rod being pushed into the pump.

51. A method according to claim 47, wherein the method comprises establishing a vacuum in the container for filling purposes and subjecting the pump to vacuum.

* * * * *